US006029971A

United States Patent [19]

Lynch et al.

[11] Patent Number: 6,029,971

[45] Date of Patent: Feb. 29, 2000

[54] SHEET FEEDING APPARATUS

[75] Inventors: Andrew Lynch; David J. McMillan; Derek S. Bell, all of Dundee, United Kingdom

[73] Assignee: NCR Corporation, Dayton, Ohio

[21] Appl. No.: 09/063,124

[22] Filed: Apr. 20, 1998

[30] Foreign Application Priority Data

May 31, 1997 [GB] United Kingdom ..... 9711182

[51] Int. Cl.[7] ..... B65H 3/04

[52] U.S. Cl. ..... 271/34; 271/149; 271/259; 221/13; 221/21; 221/259; 902/15; 902/17

[58] Field of Search ..... 902/14, 15, 17; 271/94, 96, 31.1, 34, 35, 114, 116, 121, 125, 149, 119, 118, 110, 111; 221/259, 13, 21, 277

[56] References Cited

U.S. PATENT DOCUMENTS

| | | | |
|---|---|---|---|
| 3,894,732 | 7/1975 | Muller | 271/34 |
| 4,302,000 | 11/1981 | Frank | 271/34 |
| 4,320,854 | 3/1982 | Hirose | 221/21 |
| 5,890,709 | 4/1999 | Phillips | 271/35 |

FOREIGN PATENT DOCUMENTS

| | | | |
|---|---|---|---|
| 235883 | 5/1950 | Australia | 271/34 |
| 2342615 | 3/1974 | Germany . | |
| 2946426 | 5/1981 | Germany . | |
| 3202037 | 11/1982 | Germany . | |

OTHER PUBLICATIONS

Maliwacki, Document Picker Cam, IBM Technical Disclosure Bulletin vol. 11 No. 11, Apr. 1969, p. 1587.

*Primary Examiner*—H. Grant Skaggs

[57] ABSTRACT

A belt displacement operation is periodically carried by the pick mechanism 11 of a sheet feeding apparatus, when the number of sheets fed has reaches a predetermined value. The motor 34 is driven in reverse for a predetermined time, so as to cause rotation of the belt 28 in the opposite direction to that during feeding. Since the pick pulley 26 is supported on the shaft 38 by means of a one-way clutch 40 so that it does not rotate during the reverse rotation of the belt 28, displacement of the belt 28 occurs relative to the pick pulley 26, so that in subsequent pick operations, a different portion of the belt 28 engages the stack 18 so as to pick a sheet, than had displacement of the belt 28 not occurred. This reduces the risk of localized portions of the belt 28 becoming more worn than others, due to more frequent engagement with the stack 18.

14 Claims, 4 Drawing Sheets

SHEET FEEDING APPARATUS

BACKGROUND OF THE INVENTION

The present invention relates to a sheet feeding apparatus for picking sheets one by one from a stack of sheets, and moving the picked sheets away from the stack.

Sheet feeding apparatus of this kind are commonly of either the vacuum pick or friction pick type. Vacuum pick systems use a suction member to separate the first sheet from the rest of the stack and are particularly suitable for handling sheets which are non-porous, such as currency notes in an automated teller machine (ATM). Friction type pick systems are also commonly used in ATMs. Some friction pick systems are advantageous in that they have higher feed rate capabilities than vacuum type systems and are of relatively simple construction. In addition to picking currency notes, sheet feeding apparatus of the vacuum pick or friction pick type may be used for picking other types of documents from a stack, such as photocopier sheets, tickets, vouchers, sheets of stamps, travelers cheques etc.

Friction pick systems commonly use a rotating pick roller having a high friction material disposed over its entire outer peripheral surface or over a localized area thereof. When the pick roller makes contact with a first sheet of a stack, the frictional force exerted on the sheet is greater than the frictional force between this sheet and the next sheet in the stack, which causes the first sheet to be separated from the stack and moved away by the rotating roller. However, the high friction surfaces on the picker roller tend to become worn relatively quickly and need to be replaced. This is inconvenient and expensive, as frequent maintenance of the picking mechanism is required. Moreover, the reliability of the feeding system is reduced as the friction surface becomes progressively worn.

Rotating friction belts have also been used in friction pick systems to pick sheets from a stack. One such pick apparatus is disclosed in EP-A-0559 458, where an driven endless belt is mounted on a pulley arrangement which is positioned so that, in each pick cycle, a linear portion of the rotating belt frictionally engages the first sheet of the stack, separates it therefrom, and feeds the sheet into engagement with the feed rollers of a transport mechanism which moves the sheet away from the stack. Such an arrangement is in general less susceptible to wear than friction rollers since the belt presents a larger friction area for picking. In addition, wear tends to be spread over the length of the belt rather than on a localized area thereof, since the linear portion of the belt which engages the stack is constantly changing.

Although the portion of the belt which engages the stack so as to pick a sheet therefrom, changes from one pick cycle to the next, over the lifetime of the belt, the frequency at which a particular portion of the belt engages the stack is not entirely random. During a pick operation, a belt of finite length rotates at a constant predetermined speed and a portion thereof engages the first sheet of the stack for a predetermined period of time, so as to pick the note and move it away from the stack before picking of the next note from the stack by another portion of the belt begins. A pick operation may involve a single pick cycle if only one sheet is required, or a series of successive pick cycles, if multiple sheets are required. On completion of the pick operation, the belt is brought to rest and a portion thereof remains in stationary engagement with the first sheet of the stack until a subsequent pick operation begins. Since the acceleration and deceleration times of the belt are negligible, rotation of the belt in the subsequent pick operation begins with the same portion of the belt in engagement with the stack as at the end of the previous pick operation.

Hence, over its lifetime, the portion of the belt which engages the stack during successive pick cycles begins to follow a cyclic pattern, in which some portions thereof repeatedly engage the stack while other areas of the belt never so. This results in the progressive wearing of those portions of the belt which frequently engage the stack and may eventually require replacement of the entire belt, even though substantial areas thereof are still capable of being used to perform reliable picking of sheets.

SUMMARY OF THE INVENTION

It is an object of the present invention to provide a sheet feeding apparatus of the friction pick type which is highly tolerant to wear and in which the disadvantages associated with known pick mechanisms referred to above are alleviated.

According to the present invention there is provided a sheet feeding apparatus for picking one by one, a selected number of sheets from a stack comprising rotatable belt means arranged to frictionally engage a sheet to be fed from the stack, pulley means arranged to support said belt means, and drive means for rotating said belt means, characterized by means for increasing the frictional engagement between a portion of the belt means and said sheet to be fed from the stack during a pick operation, so as to cause said sheet to be picked from the stack, and means arranged to bring about periodic relative displacement between said belt means and said pulley means.

BRIEF DESCRIPTION OF THE DRAWINGS

Embodiments of the invention will now be described by way of example with reference to the accompanying drawings, in which.

DETAILED DESCRIPTION

Figure 1:
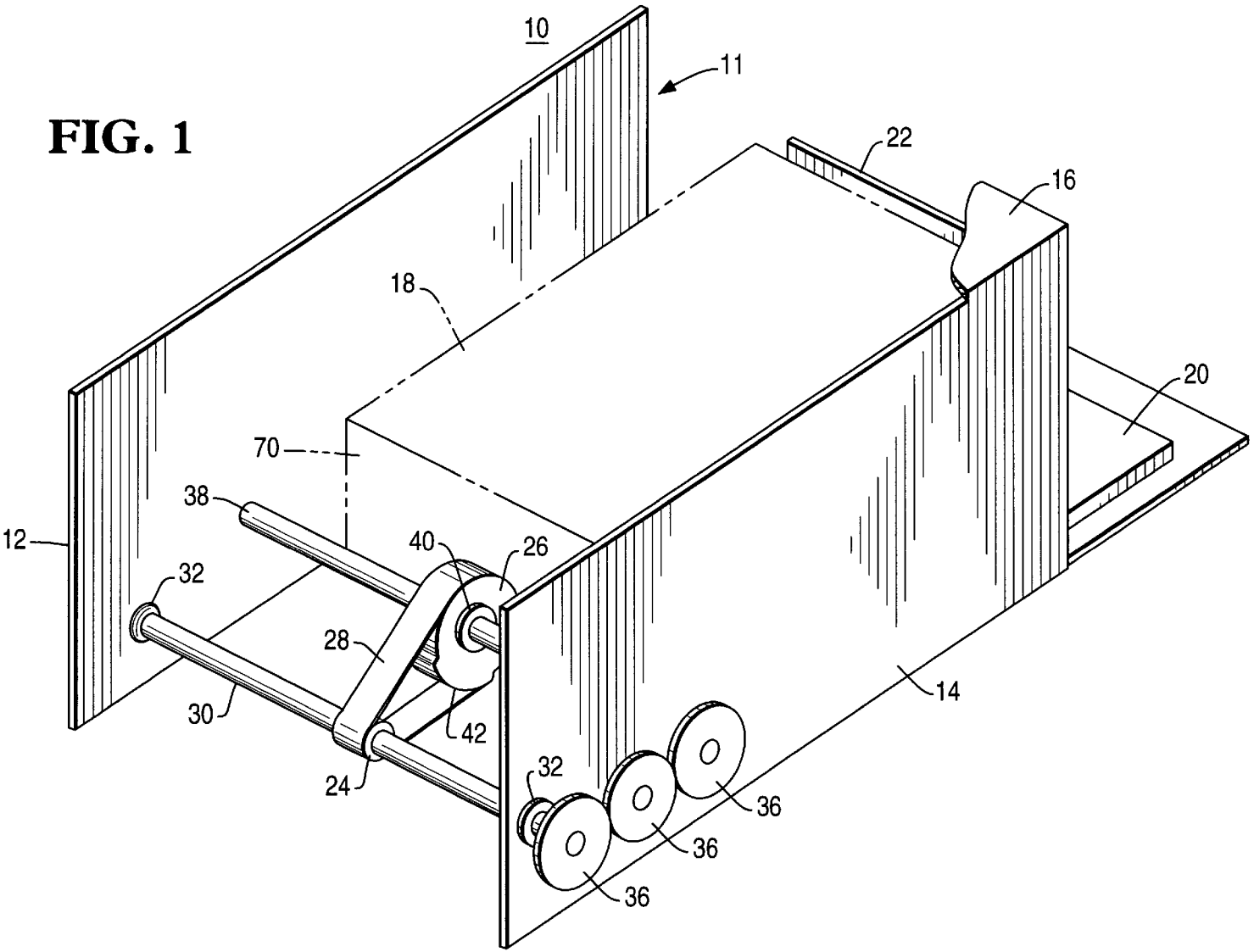
FIG. 1 is a perspective view of a sheet pick mechanism embodying the present invention, the mechanism serving to pick currency notes from an associated currency cassette.
Figure 2:
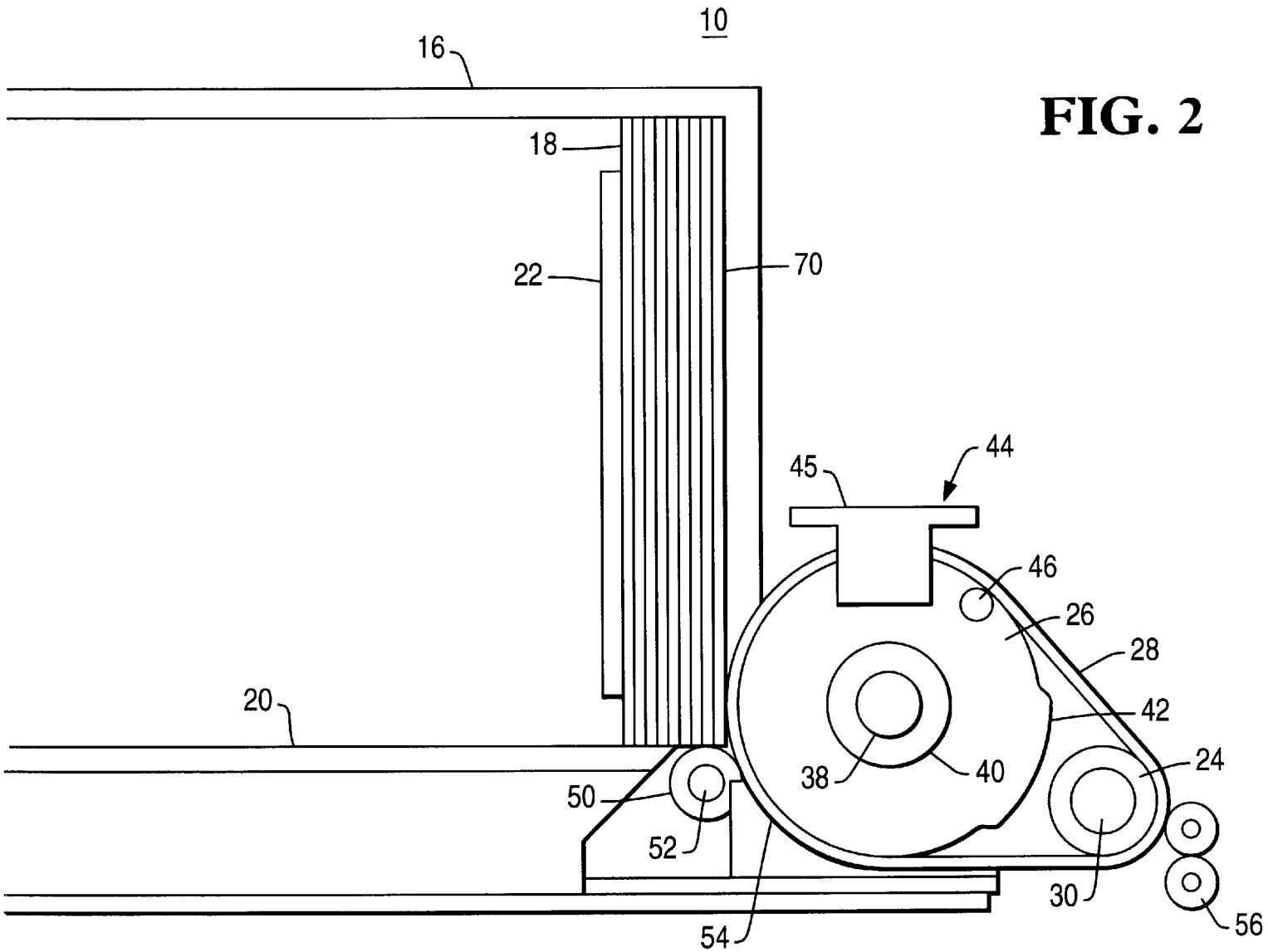
FIG. 2 is a side view of a sheet feeding apparatus including the pick mechanism of FIG. 1, the view being taken from the left hand side of FIG. 1.

Referring to FIGS. 1 and 2, the sheet feeding apparatus shown therein includes a pick mechanism 10 having a frame 11 (not shown in FIG. 2) including two vertically extending side plates 12 and 14 mounted in parallel spaced apart relation to each other. The frame 11 serves to support the various drive mechanisms and other components of the sheet feeding apparatus, as will be described hereafter. A currency cassette 16 containing a stack of currency notes 18, is removably mounted in the frame 11 between the two side plates 12 and 14. The notes in the stack 18 are supported by a base plate 20 of the cassette 16, with the notes being disposed vertically, with corresponding long edges being in engagement with the base plate 20. The stack of notes 18 is resiliently biased in a forward direction ( from left to right with reference to FIG. 2) by a pusher plate 22 which is urged against the rear of the stack of notes 18 by an arrangement of return springs (not shown).

The pick mechanism 10 includes a drive pulley 24 and a pick pulley 26 which support, and around which passes, an endless belt 28 of a high friction material such as a modified rubber. The drive pulley 24 is secured on a drive shaft 30 which extends between two bearing means 32 which are respectively supported by the side plates 12 and 14 of the frame 11. The drive shaft 30 of the drive pulley 24 is driven by an electric motor 34 (FIG. 5), via a gearing mechanism 36 mounted on the side plate 14 of the frame 11. The pick pulley 26 is rotatably mounted on a shaft 38 which is secured at both ends to the side plates 12 and 14. The pick pulley 26 is supported on the shaft 38 by means of a one way clutch 40 which is arranged to allow rotation of the pick pulley 26 in an anticlockwise direction (with reference to FIG. 2) only. The circumference of the pick pulley 26 has a cam profile, having a single lobe 42 extending over a small part of the circumference of the pick pulley 26. An optical sensor 44 (not shown in FIG. 1) is positioned adjacent the pick pulley 26, and is arranged to cooperate with an aperture 46 which extends through the pick pulley 26 from one side to the other. The sensor 44 includes a transmitter 45 and a receiver (only the transmitter 45 is visible in FIG. 2), which are disposed in parallel spaced apart relation to each other on opposite sides of the pick pulley 26.

A retard roller 50 (not shown in FIG. 1) is provided in cooperative association with the belt 28 and the pick roller 26, to prevent the feeding of two or more notes simultaneously. The retard roller 50 has an outer annular portion of rubber having a coefficient of friction which is lower than that of the fiction belt 28, and is coupled to the output shaft 52 of a motor 53 (FIG. 5), to be rotated thereby. A guide plate 54 having a curved guide surface extends from adjacent the nip formed between the belt 28 and the retard roller 50 and serves to guide notes which have been picked from the stack 18 towards the feed rollers 56 of a transport mechanism. For simplicity, only one pair of feed rollers 56 are shown in FIG. 2, but it should be understood that the transport mechanism is of conventional design and typically includes a plurality of pairs of feed rollers 56 which move the notes which have been picked away from the cassette 16. A sensor 72 (FIG. 5) is positioned adjacent the first pair of feed rollers 56 of the transport mechanism, so as to detect when the leading edge of a note has been engaged thereby.

The various mechanisms within the sheet feeding apparatus shown in FIGS. 1 and 2 are controlled by a processor unit 62 and a control circuit 64. The processor unit 62 may include a microcomputer and communicates with the control circuit 64 which provides the control of power to the motor 34 (FIG. 5) of the drive shaft 30, the motor 53 (FIG. 5) of the retard roller shaft 50, and the sensors 44 and 72 (FIG. 5) and also provides timing control.

Also, it should be understood that, although only one belt 28 and associated pulleys 24 and 26 have been illustrated and described with reference to FIGS. 1 and 2, in practice, two or more belts 28 and associated drive and pick pulleys (24, 26) could be provided, with each drive pulley 24 being secured on the drive shaft 30, and a separate retard roller 50 being cooperatively associated with each belt 28.

The operation of the above-described apparatus for picking notes will now be described with continuing reference to FIGS. 1 and 2.

When a pick operation request is received by the processor unit 62, activation signals are sent by the control circuit 64 to the motors 34 and 53 of the drive shaft 30 and the retard roller 50, and to the sensors 44 and 72. The pick operation request may be a single note command, in which case only one pick cycle is to be carried out, or a multiple note command, in which case successive pick cycles are to be carried out until the desired number of notes have been picked from the cassette 16. The motor 34 drives the drive shaft 30 via the gearing mechanism 32, causing the drive pulley 24 and the friction belt 28 to rotate in an anticlockwise direction (with reference to FIG. 2). As the friction belt 28 is driven, the pick pulley 26 is also caused to rotate in an anticlockwise direction (with reference to FIG. 2) about the axis of the shaft 38.

The pusher plate 22 is urged against the rear of the stack 18, biasing it towards the pick pulley 26. A portion of the rotating friction belt 28 engages the first note 70 of the stack 18, but the differential frictional force required to separate the note 70 from the stack 18 is not sufficient until the pick pulley 26 has rotated to a position where the cam lobe 42 on the circumference thereof engages the opposed side of the portion of the belt 28 in engagement with the first note 70. The cam lobe 42 causes this portion of the belt 28 to be deflected towards the stack 18, increasing the pressure exerted by the belt 28 on the stack of notes 18. The frictional force exerted by the belt 28 on the note 70 is now greater than that between the note 70 and the note adjacent thereto in the stack 18, and the note 70 is separated from the stack 18 and moved into the nip between the belt 28 and the retard roller 50 by the rotating belt 28.

The picked note 70 continues to be moved away from the stack 18 and is guided by the guide plate 54 until its leading edge is gripped between the first pair of feed rollers 56 of the transport mechanism. As the belt 28 and the pick pulley 26 continue to rotate, the cam lobe 42 on the circumference of the pick pulley 26 is disengaged from the belt 28, so that the pressure exerted by the belt 28 on the stack 18 is reduced and is insufficient to cause separation of the next note from the stack 18. The sensor 72 (FIG. 5) detects when the leading edge of the picked note 70 is gripped between the feed rollers 56 and sends a signal to the processor unit 62. The feed rollers 56 of the transport mechanism then carry the note 70 away from the stack 18 to a remote stacking or collection point.

The retard roller 50 is driven to rotate in the opposite direction to, and at a significantly lower speed than, the belt 28, and engages the rear surface of the picked sheet 70 as it is moved by the belt 28 through the nip between the retard roller 50 and the belt 28. The frictional force exerted by the belt 28 on the front side of the note 70 is greater than the frictional force exerted by the retard roller 50 in the opposite direction on the rear side of the note 70. In the event that superposed notes are picked from the stack 18 and moved into the nip, the difference in speed and direction of rotation of the belt 28 and the retard roller 50 which engage opposed surfaces of the superposed notes, causes separation of notes from one another. The first note continues to be moved by the belt 28 towards the feed rollers 56, while the other note or notes are restrained by the retard roller 50 from being fed through the nip between the retard roller 50 and the belt 28.

If a pick operation request for a single note was received by the processor unit 62, the pick operation is complete on receipt of a signal from the sensor 72 that the leading edge of note 70 has been engaged with the feed rollers. The motors 34 and 53, and the sensors 44 and 72 are then de-energized by the control circuit 64 until a subsequent pick operation request is received by the processor unit 62. It should be understood that the dimensions of the pick pulley 26 are such that the leading edge of the picked note 70 will be engaged by the first pair of feed rollers 56 of the transport mechanism before the pick pulley 26 has made a complete revolution. Otherwise, the cam lobe 42 on the circumference of the pick pulley 26 would engage the opposed side of the belt 28 which is in engagement with the stack 18 once more, and would cause separation of a second note therefrom.

If a multiple note pick operation request was received by the processor unit 62, multiple pick cycles are required in order to complete the pick operation. In such a case the motors 34 and 53 and sensors 44 and 72 are maintained in an energized condition by the control circuit 64 and the belt 28 and pick pulley 26 continue to rotate. When the cam lobe 42 engages the opposed side of the portion of the belt 28 in engagement with the second note of the stack 18 during the second revolution of the pick pulley 26, this note is picked from the stack 18 and moved toward the feed rollers 58 of the transport mechanism, in the manner described. This process is repeated until the desired number of notes have been picked from the stack 18.

On receipt of a signal from the sensor 72 by the processor unit 62 after the final pick cycle, the motors 34 and 53 and sensors 44 and 72 are de-energized by the control circuit 64, and the belt 28 is brought to rest until a subsequent pick operation request is received by the processor unit 62.

The optical sensor 44 remains energized throughout the pick operation, causing a light beam to be emitted by the transmitter 45. As the pick pulley 26 rotates the path of the light beam is blocked thereby, except in a position where the aperture 46 in the side of the pick pulley 26 is aligned with the transmitter 45 and receiver of the sensor 44. In this position, the beam passes through the aperture 46 and is detected by the receiver, which transmits a signal to the processor unit 62. Since alignment of the transmitter 45 and receiver with the aperture 46 occurs once per revolution of the pick pulley 26, a signal is received by the processor unit 62 for each revolution thereof. Hence, the number of revolutions made by the pick pulley is recorded by processor unit 62. This should also correspond to the number of notes picked by the pick mechanism 10, since the cam lobe 42 also engages the belt 28 once per revolution of the pick pulley 26, causing a note to be picked from the stack 18.

The note feeding apparatus of the present invention has improved tolerance to wear of the belt 28, since the belt 28 is in high frictional engagement with the stack of notes 18 only for the minimum time required to pick a note therefrom, i.e., the short time period in which the cam lobe 42 on the circumference of the pick pulley 26 engages the opposed side of the portion of the belt 28 in engagement with the note to be picked from the stack 18. The lifetime of the belt 28 is therefore increased and less frequent maintenance is required.

The tolerance of the belt 28 to wear is further improved in that a belt displacement operation is periodically carried out by the apparatus throughout the lifetime of the belt 28. A belt displacement operation of the picking mechanism will now be described with continuing reference to FIGS. 1 and 2, and to the flow diagram of FIG. 3. As described above, the processor unit 62 maintains a record of the total number of revolutions (N) of the pick pulley 26, which is an indication of the number of notes which have been picked by the belt 28 throughout its lifetime. In step 100 (FIG. 3), the processor unit 62 determines whether the number of revolutions of the pick pulley 26 (N) has reached a predetermined value (nX), where n an integer and X is a predetermined number such as 1000. The processor unit 62 then checks whether the pick mechanism 11 is in an idle condition at this time or whether a pick operation is in progress (step 102). If the picking mechanism 11 is idle, the processor unit 62 initiates a belt displacement operation and the control circuit 64 energizes the motor 34 of the drive shaft 30 to be driven in a reverse direction (steps 104 and 106) for a predetermined period of time. This causes the drive pulley 24 and the friction belt 28 to rotate in a clockwise direction (with reference to FIG. 2), i.e. in the opposite direction to rotation thereof during a pick operation. Since the pick pulley 26 is supported on the shaft 38 by means of the one-way clutch 40, so that rotation thereof is possible only in anticlockwise direction (with reference to FIG. 2), the pick pulley 26 remains stationary as the belt 28 rotates, causing slipping of the belt 28 relative to the pick pulley 26 during that time period. On the elapse of said predetermined time, the motor 34 is denergized by the control circuit 64 and the drive pulley 24 and friction belt 28 come to rest. The belt displacement operation is now complete (step 108).

If a pick operation is in progress when the number of revolutions N by the pick pulley 26 reaches the predetermined value nX in step 102, the pick operation continues in the manner described above, until the desired number of notes have been picked from the stack 18 (step 103). On completion of the pick operation, a belt displacement operation is initiated by the processor unit 62 and proceeds in the manner described above. When a further X sheets have been picked by the pick mechanism 11, the belt displacement operation is repeated. For example, such a belt displacement operation could be carried out for every 1000 notes picked by the mechanism 11.

Slipping of the belt 28 for a predetermined time causes it to be displaced by a predetermined distance relative to the pick pulley 28, so that a different portion thereof engages the stack of notes 18 at the end of the belt displacement operation. Due to this relative displacement, during subsequent pick operations, the cam lobe 42 on the circumference of the pick pulley is caused to engage a different portion of the rotating belt 28 so to cause picking of the first sheet therefrom, than had the belt displacement operation not been carried out. Hence, the effect of the belt displacement operation may be thought of as breaking the "cycle" of the belt 28, since a different portion thereof is caused to engage the stack 18 than would have occurred otherwise. By periodically carrying out such a belt displacement operation over the lifetime of the belt 28, i.e. after each X notes picked by the mechanism 11, the probability that particular portions of the belt 28 will become more worn than the others because of more frequent engagement with a stack of notes 18, is significantly reduced. Instead, wear of the belt 28 tends to be spread over its length rather than in localized areas. The belt 28, therefore, is capable of reliable picking for considerably longer than the belts used in known sheet feeding apparatus.

Figure 3:
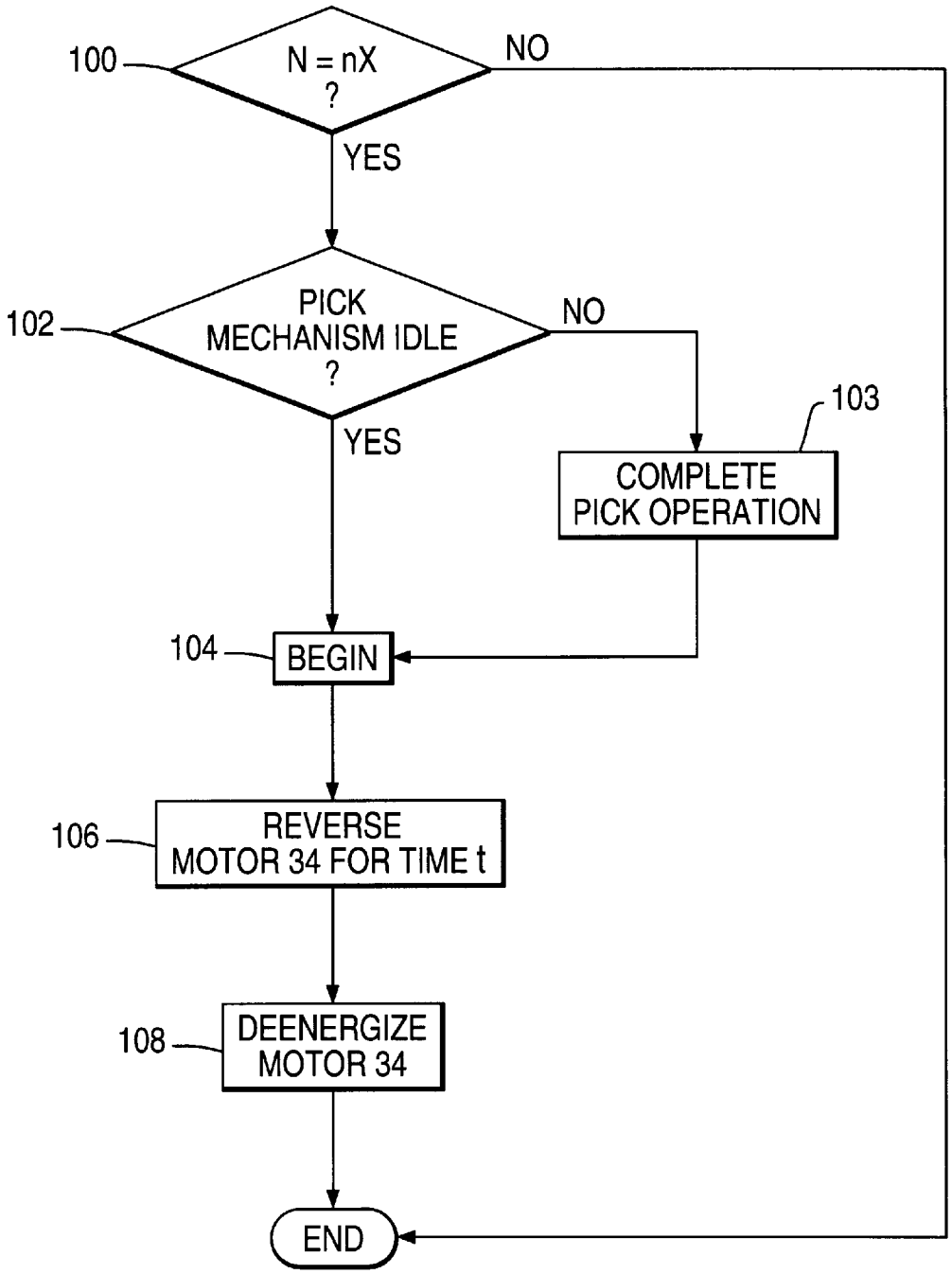
FIG. 3 is a flow diagram representing a belt displacement operation of the sheet feeding apparatus of FIGS. 1 and 2.
Figure 4:
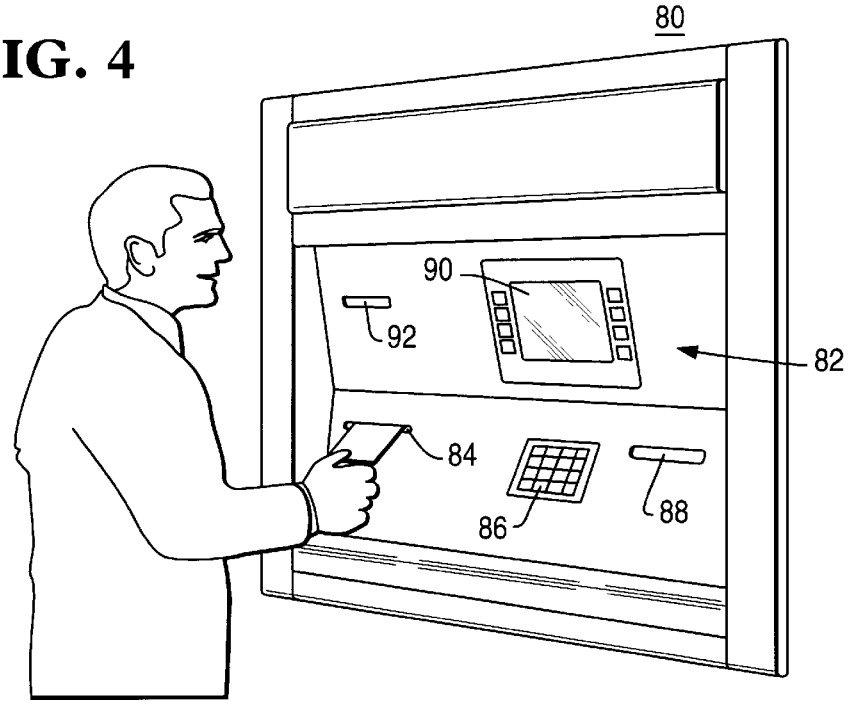
FIG. 4 is a external perspective view of an automated teller machine (ATM) in which the sheet feeding apparatus of FIGS. 1 and 2 may be used.
Figure 5:
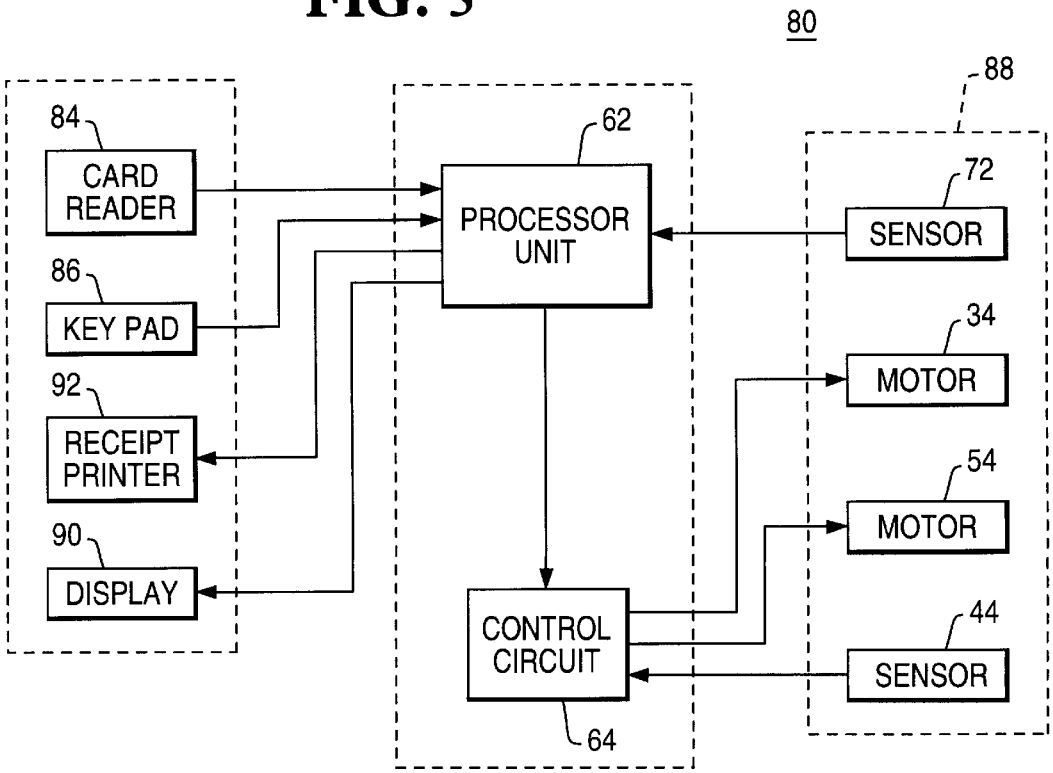
FIG. 5 is a block diagram representation of the ATM of FIG. 4.

Referring now additionally to FIGS. 4 and 5, the note feeding apparatus described with reference to FIGS. 1 to 3 is used in a cash dispenser 88 of an automated teller machine (ATM) 80. The cash dispenser 88 would normally include more than one note feeding apparatus, each associated with a separate currency cassette 16. The ATM 80 includes a user interface on its front panel 82 and includes a card reader 84, a key pad 86, a cash dispenser 88, a CRT display screen 90, a receipt printer 92 and a control unit 60. The card reader 84, the cash dispenser 88 and the receipt printer 92 have associated slots located on the front panel 82 of the ATM 80, for insertion of a user's identifying card at the commencement of a transaction and for delivery of currency notes and a receipt to a user during a cash withdrawal transaction, respectively. The cash dispenser 88 includes the note feeding apparatus of FIGS. 1 and 2 and stacking and transport mechanisms. The processor unit 62 controls operation of components of the front panel 82 and various other operating mechanisms of the ATM 80.

In a typical ATM cash withdrawal transaction, a user inserts his card into the card reader slot 84 and data encoded on the card is read. Instructions are then displayed on the screen 90. The user is requested to enter a personal identification number (PIN) on the key pad 86 which is verified, usually at a central location remote from the ATM 80. If the PM is determined to be correct, a menu of the various facilities available to the customer is then displayed on the screen 90. If a cash withdrawal facility is selected, the customer is requested to enter the sum required on the key pad 86. This request is transmitted to the processor unit 62 as a pick operation request for the number of currency notes to be dispensed to the user. The note feeding apparatus of the cash dispenser 86 operates in the manner described above until the desired number of notes are picked from a currency cassette 16. The picked notes are fed by the feed rollers 56 of the transport mechanism of the cash dispenser 88 to a stacking mechanism (not shown) and are then delivered to the user through the cash dispenser slot in the front panel 82 of the ATM 80.

In another embodiment of the present invention, a belt displacement operation is carried out when wear of the belt 28 is detected. As described earlier, for each revolution of the pick pulley 26, one note should be picked from the stack 18. During each pick cycle two signals are received by the processor unit 62, namely, a signal from the receiver of the sensor 44 to indicate one revolution of the pick pulley 26, and a signal from the sensor 72, on detection of the leading edge of a note which has been picked from the stack 18 having engaged the first pair of feed rollers 56 of the transport mechanism. In the event that the portion of the belt 28 which engages the first note of the stack 18 has become worn to such an extent that its frictional properties are no longer sufficient to cause the note to be separated from the stack, no signal is transmitted by the sensor 72 to the processor unit 62. Since the pick pulley 26 continues to rotate, a signal is transmitted by the sensor 44 to the processor unit 62 for this pick cycle. This discrepancy is detected by the processor unit 62 which immediately initiates a belt displacement operation so as to bring a different portion of the belt 28 into engagement with the stack 18. In this case, the current pick operation being carried out by the pick mechanism 11 is interrupted and a belt displacement operation is carried out immediately by causing the motor 34 to operate in reverse for a predetermined time, so as to minimize the risk of further mispicks during that pick operation.

It should be understood that such a belt displacement operation, initiated on detection of wear of the belt 28 as described above, could also be carried out in addition to the periodic belt displacement operations initiated when a predetermined number of notes have been picked by the picking mechanism 11.

What is claimed is:

1. A sheet feeding apparatus for picking a selected number of sheets one by one from a stack of sheets, the sheet feeding apparatus comprising:

rotatable belt means for frictionally engaging a sheet to be fed from the stack;

pulley means for supporting the belt means;

drive means for rotating the belt means;

means for increasing the frictional engagement between a portion of the belt means and a sheet to be fed from the stack during a pick operation, so as to cause the sheet to be picked from the stack; and belt displacement means for bringing about periodic relative displacement between the belt means and the pulley means, so as to change the position of the belt means relative to the next sheet to be fed from the stack.

2. A sheet feeding apparatus according to claim 1, wherein the belt displacement means brings about relative displacement between the belt means and the pulley means when a predetermined number of sheets have been fed.

3. A sheet feeding apparatus according to claim 2, further comprising sheet detection means for detecting the number of sheets fed.

4. A sheet feeding apparatus according to claim 1, further comprising wear detection means for detecting wear of the belt means, the belt displacement means for bringing about relative displacement between the belt means and the pulley means when the detection means detects wear of the belt means.

5. A sheet feeding apparatus according to claim 1, wherein the pulley means is associated with a one-way clutch, so as to enable relative displacement to be brought about between the belt means and the pulley means.

6. A sheet feeding apparatus according to claim 1, wherein the pulley means includes a number of lobes to provide a cam profile, the frictional engagement between a portion of the belt means and a sheet to be fed from the stack increasing when a lobe of the pulley means engages that portion of the belt means.

7. A sheet feeding apparatus according to claim 6, wherein the number of lobes includes a single lobe.

8. An automated teller machine (ATM) having at least one currency cassette containing currency notes, the ATM comprising:

rotatable belt means for frictionally engaging a currency note to be fed from the currency cassette;

pulley means for supporting the belt means;

drive means for rotating the belt means;

means for increasing the frictional engagement between a portion of the belt means and a currency note to be fed from the currency cassette during a pick operation, so as to cause the currency note to be picked from the cassette; and belt displacement means for bringing about periodic relative displacement between the belt means and the pulley means, so as to change the position of the belt means relative to the next currency note to be fed from the currency cassette.

9. An ATM according to claim 8, wherein the belt displacement means brings about relative displacement between the belt means and the pulley means when a predetermined number of currency notes have been fed.

10. An ATM according to claim 9, further comprising currency note detection means for detecting the number of currency notes fed.

11. An ATM according to claim 8, further comprising wear detection means for detecting wear of the belt means, the belt displacement means for bringing about relative displacement between the belt means and the pulley means when the detection means detects wear of the belt means.

12. An ATM according to claim 8, wherein the pulley means is associated with a one-way clutch, so as to enable relative displacement to be brought about between the belt means and the pulley means.

13. An ATM according to claim 8, wherein the pulley means includes a number of lobes to provide a cam profile, the frictional engagement between a portion of the belt means and a currency note to be fed from the currency cassette increasing when a lobe of the pulley means engages that portion of the belt means.

14. A sheet feeding apparatus according to claim 13, wherein the number of lobes includes a single lobe.

* * * * *

UNITED STATES PATENT AND TRADEMARK OFFICE

CERTIFICATE OF CORRECTION

PATENT NO. : 6,029,971
APPLICATION NO. : 09/063124
DATED : February 29, 2000
INVENTOR(S) : Andrew Lynch et al.

It is certified that error appears in the above-identified patent and that said Letters Patent is hereby corrected as shown below:

Column 8, Line 61, delete "A sheet feeding apparatus" and insert -- An ATM --.

Signed and Sealed this

Seventh Day of August, 2007

JON W. DUDAS
*Director of the United States Patent and Trademark Office*